United States Patent [19]

McCammon et al.

[11] 4,144,506

[45] Mar. 13, 1979

[54] COAXIAL LINE TO DOUBLE RIDGE WAVEGUIDE TRANSITION

[75] Inventors: John W. McCammon, Redwood City; George Imokawa, San Jose, both of Calif.

[73] Assignee: Litton Systems, Inc., San Carlos, Calif.

[21] Appl. No.: 835,878

[22] Filed: Sep. 23, 1977

[51] Int. Cl.[2] ..... H01P 5/10

[52] U.S. Cl. ..... 333/26; 333/33

[58] Field of Search ..... 333/21 R, 26, 33

[56] References Cited

U.S. PATENT DOCUMENTS

| | | | |
|---|---|---|---|
| 2,982,927 | 5/1961 | Grimm et al. | 333/33 X |
| 3,146,410 | 8/1964 | Butler | 333/21 R |
| 3,188,583 | 6/1965 | Boyd | 333/26 |

*Primary Examiner*—Paul L. Gensler

*Attorney, Agent, or Firm*—Norman E. Brunell; Ronald M. Goldman; Walter R. Thiel

[57] ABSTRACT

A novel structure in a coaxial to waveguide transmission line transition includes a waveguide section having longitudinally extending ridges on two opposed walls; a metal impedance transition member extending from one wall of the waveguide having a geometry within the waveguide of three right cylinders of dissimilar size stacked upon one another to form a steplike arrangement and a central passage therethrough; a dielectric cylindrical member extends into said waveguide from an opening in a waveguide wall opposed to that of the transition member and is in abutting relationship with the end of said impedance transition member; an elongate rodlike conductor extends axially through said dielectric member and said impedance transition; further each of the longitudinally extending waveguide ridges includes an outwardly flared portion of increasing width, one of which abuts the periphery of the lower step of said transition member and the other of which is spaced a predetermined distance from said dielectric member to define a gap; and a waveguide cavity is formed on one side of said impedance transition member and a positionable shorting wall borders one side of said cavity.

5 Claims, 2 Drawing Figures

COAXIAL LINE TO DOUBLE RIDGE WAVEGUIDE TRANSITION

BACKGROUND OF THE INVENTION

This invention relates to apparatus for coupling microwave energy from a coaxial type transmission line to a double ridged waveguide transmission line and, more particularly, to a coax to waveguide transition which provides acceptable impedance matching between input and output transmission lines over a relatively broad bandwidth of microwave frequencies.

It is common practice in microwave transmission systems and in microwave devices, such as traveling wave tubes, to employ different types of microwave frequency transmission lines of known types, such as the coaxial type and the double ridged waveguide type, which have different electrical characteristics, such as characteristic impedance. It is also conventional in such systems to form a microwave energy transmission path for propagating microwave energy from one location to another in which the propagation path is formed of more than one kind of transmission line having different electrical transmission characteristics, such as the coaxial type and the double ridged waveguide type, a subject to which the present invention is directed. The coupling or connection between those two types of transmission lines is accomplished with reasonable efficiency by coupling means that are referred to by those skilled in the art as microwave transitions, or simply transitions.

Heretofore, many different physical structures for accomplishing a good electrical coupling between a coax and a waveguide line performing the function of a transition have been known, such as appears in the patents, believed to be exemplary of the prior art, U.S. Pat. Nos. 3,725,824, 3,737,812, 3,478,282, 3,528,041 and 3,431,515, which have been made known to us, to which the reader's attention is directed for additional background information. In its essentials, the output of the transition contains the configuration of a conventional waveguide type transmission line; the input of the transition contains the structure of the conventional coaxial type transmission line containing a central conductor surrounded by a dielectric; and intermediate the aforedescribed elements is employed an impedance matching section formed of tapered metal section or metal steps, physically resembling a staircase, or modifications and variations thereof.

The present invention is directed to a novel structure in a coax to waveguide transition of the recited type and has as a principal object the coupling of mircrowave energy over the frequency range of 8 to 18 gigahertz with reasonable levels of voltage standing wave ratios of between 1 and 2. An ancillary object of the present invention is to define a physical structure of a transition which is easy to fabricate and adjust.

SUMMARY OF THE INVENTION

The transition of the invention includes a rectangular waveguide section having first and second ends, and longitudinally extending ridges depending from each of two opposed walls with an end section of the ridges being outwardly tapered. A step impedance matching section protrudes within the waveguide and is of a geometry of a stack of three short cylinders of decreasing radii, the first cylinder serving as a base protruding into the guide a short distance beyond the outer surface of one ridge; a second cylinder of smaller radius atop the first oriented with a portion of the periphery thereof tangent to the periphery of the first cylinder; and a third cylinder of still smaller radius atop the second mounted coaxial therewith; the overall height of the in-the-guide portion of the step impedance matching member being less than the distance between opposed walls of the waveguide but greater than the distance between ridges; further, a dielectric member having a cylindrical portion extends into the waveguide fom an opposed wall and is in abutting relation with the end of the third cylinder; and a relatively straight electrical conductor extends coaxially through the dielectric member and into the step impedance matching member.

Additionally, the first ridge member abuts the first cylindrical portion and the secnd ridged member has an end spaced longitudinally from the dielectric member and from the third cylindrical portion so as to define a microwave energy propagation gap. The foregoing objects and advantages of the invention, together with the structure characteristic of the invention, as well as alterations and modifications thereof, become more apparent from a consideration of the invention which follows, taken together with the figures of the drawings illustrative thereof.

DESCRIPTION OF THE PREFERRED EMBODIMENTS

Figure 1:
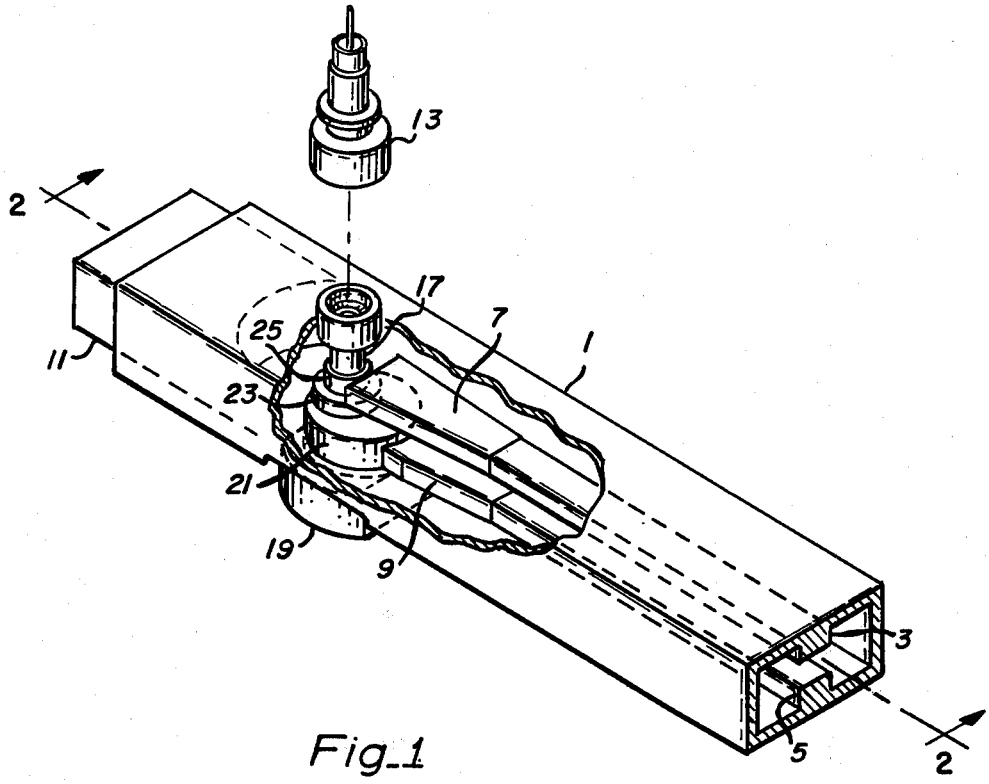
FIG. 1 illustrates in perspective a preferred embodiment of the novel microwave transition.

Reference is now made to the embodiment of FIG. 1 in which a coax to waveguide transition, constructed according to the invention, is presented in a perspective view and in which a portion of the waveguide is cut away, revealing the geometry and relationship of the enclosed elements. The structure includes a waveguide section 1 which in cross section is of conventional double ridged geometry, as is visible at the lower right hand side end in the figure, and in which the upper and lower walls contain depending protruding rectanguloid rigdes 3 and 5 that extend over a length of the waveguide, as represented by invisible lines. The upper ridge 3 contains an outwardly tapered extended portion 7 which commences at the end of the uniform ridge section and widens over its length terminating in a flat edge. The portion is of a trapezoidal-like geometry and is of a height essentially equal to that of the ridge section 3. Another tapered ridge section 9 adjoins the end of and forms an extension of the lower straight ridge 5 and is of the same height. The tapered ridge 9 increases in width to the left along its length and has a cylindrical end surface for reasons which become more apparent from the following description.

Figure 2:
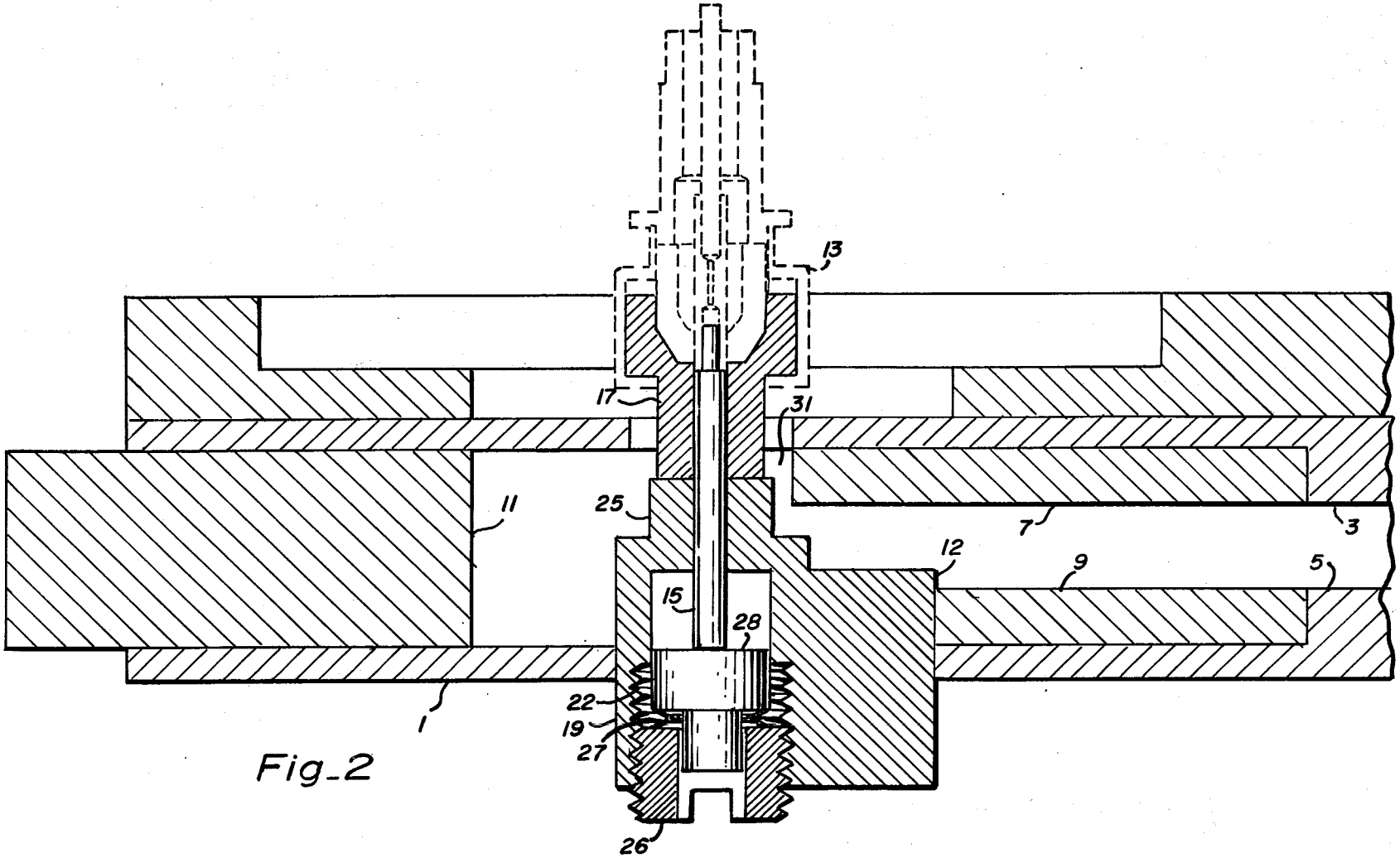
FIG. 2 is a section view to enlarged scale of the embodiment of FIG. 1 taken along the lines 2—2.

The left side end of waveguide 1 does not contain ridges but includes a positionable shorting plunger 11 or shorting wall which fits within the walls of the waveguide. The end surface of the plunger, as represented in dotted or invisible lines is of a concave cylindrical configuration and serves to block this end of the waveguide interior and define a cavity to one side of impedance transition section 9. A coaxial input member 13 includes an elongate center conductor 15 and an intermediate cylindrical shaped dielectric member 17. The dielectric member 17 contains an end geometry which is of a right cylinder and protrudes within the enclosed regions of the waveguide. An impedance matching member, generally represented as 19, extends though a opening in one wall into the waveguide. Member 19 is machined metal part, suitably copper, unitary in structure and contains a portion which protrudes within the interior of the waveguide which resembles three right cylinders, 21, 23 and 25, stacked one atop the other to form a series of steps. In order to describe more fully the structural relationship of the foregoing elements, reference is made to the cross section view presented in FIG. 2 which is drawn to a slightly greater scale than that of FIG. 1 but in which identical parts are identically labeled. As is apparent from this view, it is seen that the cylindrical portion 21 of element 19 is inserted into the waveguide so that it protrudes from the upper wall to a greater depth than the height of the adjacent ridge 9 so as to form a step 12 therebetween. Moreover, the second cylinder portion 23 is of a smaller radius than the corresponding radius of first cylinder portion 21 and the axis of this portion is displaced from the axis of cylinder 21. However, the second cylinder is oriented so that the left hand periphery is tangent to the same bisecting plane normal to the plane of the paper through which the left most peripheral portion of the first cylinder is tangent. The third cylinder portion 25 is of a radius which is less than the radius of cylinder portion 23 but has its axis coaxial with that of cylinder portion 23 so as to form a step on both the left and right hand sides. As is noted from the figure, the overall height of the portion of member 19 located within the waveguide section is less than the distance between the opposed upper and lower waveguide walls but greater than the spacing between the outer edges of ridges 9 and 7. The cylindrical portion of dielectric 17 extends from an opening in an opposed waveguide wall within the waveguide. The end surface thereof abuts the top of cylindrical portion 25. The elongate conductor 15 is seen to extend through a passage in dielectric member 17 and through a corresponding coaxial passage in member 19. As seen in this figure, the member 19 contains a hollowed out cylindrical portion containing a threaded wall 22, a threaded metal plug 26 and a circular spring 27 and cylindrical guide 28 adapted to apply an axial pushing force to the end of conductor 15. As is presented, the end of tapered ridge 9 abuts the outer peripheral surface of cylindrical portion 21. However, the opposed tapered ridge 7 terminates at a distance from the cylindrical portions 25 and dielectric member 17 so as to define a gap 31 through which microwave energy may pass. It is recognized that the outer surface of members 15 and 17 is configured as a female connector which is adapted to mate with any suitable RF coaxial transmission line connector 13 as shown in an exploded view in FIG. 1 and by dash lines in FIG. 2. By way of specific example, the waveguide used is type WRD-750-D24 of a dimension 0.691 inches by 0.321 inches, containing ridges 0.173 inches by 0.0925 inches. The in-the-guide height of cylindrical sections 21, 23 and 25 is 0.125 inches, 0.055 inches and 0.095 inches, respectively. Opening 30 is of a 0.250 inch diameter and dielectric member 17 of "TEFLON" is approximately 0.165 inches in diameter. The gap between the end of tapered ridge 7 and the peripheral surface of cylindrical portion 25 is approximately 0.020 inches.

In one practical embodiment of the invention the transition was operated on test equipment over a frequency range of 8 to 18 gigahertz and the VSWR at any frequency within that range did not appear to exceed a VSWR of 1.6.

All of the foregoing elements are constructed of electrically conductive metal, suitably copper, unless an element is otherwise described as a dielectric.

It is believed that the foregoing description of a preferred embodiment of the invention is sufficient in detail to enable those skilled in the art to make and use same. However, it is expressly understood that the details presented for the foregoing purpose are not intended to limit the invention inasmuch as modifications or substitution of equivalent elements or even improvements become apparent to those skilled in the art upon reading this specification, all of which embody the invention. Accordingly it is respectfully requested that the invention be broadly construed within the full spirit and scope of the appended claims.

What is claimed is:

1. A coaxial line to ridged rectangular waveguide transition for coupling microwave energy comprising:

(a) a rectangular waveguide section of metal material containing first and second ends, top, bottom and side walls defining a hollow interior, and an end wall at or approximate said first end, longitudinally extending opposed first and second ridges of first and second predetermined length extending from said second end and located on the inner surfaces of the top and bottom walls, respectively, each of said ridges being of a predetermined short height, $d_0$, each of said ridges containing an end section of relatively uniform rectanguloid section and a flared section of increasing with outwardly tapered with the latter section located remote from said second end;

(b) impedance transition means of metal material extending into the waveguide through one of said top and bottom walls, said transition means having a portion protruding within said waveguide interior, said protruding portion having a geometry which includes:

a first right cylindrical portion of radius, $r_1$, having a first axis and a height, $d_1$, slightly greater than the height, $d_o$, of said ridges;

a second right cylindrical portion of radius, $r_2$, having a second axis and a short height, $d_2$, located on top of and within the surface defined by said first cylindrical portion;

said second axis displaced from said first axis and said radius, $r_2$, being less than said radius, $r_1$;

and with an outer surface portion located most remote from said second waveguide end of said two cylindrical portions being tangent to a common plane orthogonal to the axis of said waveguide section along a common line in said plane;

a third right cylindrical portion having a radius, $r_3$, a third axis, and a height, $d_3$, located on top of and within the surface defined by said second cylindrical portion;

with said third axis being coaxial with said second axis and wherein said third radius, $r_3$, is smaller than said second radius, $r_2$;

the sum of the heights of said cylindrical portions within said waveguide interior, $d_1+d_2+d_3$, being less than the distance between said top and bottom walls of said waveguide section but greater than the distance between said opposed ridges;

a dielectric member pervious to microwave energy having a cylindrical portion extending into said waveguide section interior from an opposed wall thereof coaxially with said third cylindrical portion and abutting the end thereof;

an elongate rodlike conductor member extending through said dielectric member and into said cylindrical portions for conducting microwave energy into said waveguide section;

said first tapered ridge section containing a concavely cylindrical end periphery located in abutting relation with said first cylindrical portion;

said second tapered ridge section containing an end surface spaced from said third cylindrical portion by a slight distance and being spaced from said dielectric member by a slight distance; and said dielectric member and said rodlike conductor member having an end geometry and relationship for coupling of a coaxial type connector.

2. The invention as defined in claim 1 wherein said impedance transition means includes a hollow cylindrical chamber coaxial with the axis of said third cylindrical portion and wherein said rodlike conductor member extends within said chamber and further comprising: spring means located in said chamber for applying an axial biasing pushing force in said rodlike conductor member.

3. The invention as defined in claim 2 further including plug means for holding said spring means within said chamber.

4. The invention as defined in claim 1 wherein said end wall of said waveguide section is adjustably positionable.

5. The invention as defined in claim 1 wherein said end wall of said waveguide section is of a concave cylindrical geometry.

* * * * *